US010344371B2

(12) United States Patent
Taniguchi et al.

(10) Patent No.: US 10,344,371 B2
(45) Date of Patent: Jul. 9, 2019

(54) STEEL SHEET FOR SOFT-NITRIDING TREATMENT, METHOD OF MANUFACTURING SAME, AND SOFT-NITRIDED STEEL

(71) Applicant: NIPPON STEEL & SUMITOMO METAL CORPORATION, Tokyo (JP)

(72) Inventors: Shunsuke Taniguchi, Tokyo (JP); Eisaku Sakurada, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 363 days.

(21) Appl. No.: 15/318,153

(22) PCT Filed: Jun. 15, 2015

(86) PCT No.: PCT/JP2015/067217
§ 371 (c)(1),
(2) Date: Dec. 12, 2016

(87) PCT Pub. No.: WO2015/190618
PCT Pub. Date: Dec. 17, 2015

(65) Prior Publication Data

US 2017/0130318 A1 May 11, 2017

(30) Foreign Application Priority Data

Jun. 13, 2014 (JP) ..... 2014-122568
Oct. 14, 2014 (JP) ..... 2014-209974

(51) Int. Cl.
*C23C 8/26* (2006.01)
*C22C 38/22* (2006.01)
(Continued)

(52) U.S. Cl.
CPC ..... *C23C 8/26* (2013.01); *C21D 8/0226* (2013.01); *C21D 8/0278* (2013.01); *C21D 9/46* (2013.01);
(Continued)

(58) Field of Classification Search
CPC .... C23C 8/00; C23C 8/26; C21D 8/00; C21D 8/0226; C21D 8/0278; C21D 9/46;
(Continued)

(56) References Cited

U.S. PATENT DOCUMENTS

2014/0027022 A1 1/2014 Yokoi et al.
2014/0334966 A1 11/2014 Sakurada et al.

FOREIGN PATENT DOCUMENTS

CN 1166185 A 11/1997
CN 103221566 A 7/2013
(Continued)

OTHER PUBLICATIONS

WO 2013/077298 Machine Translation (Year: 2019).*
(Continued)

*Primary Examiner* — Alexandra M Moore
(74) *Attorney, Agent, or Firm* — Birch, Stewart, Kolasch & Birch, LLP

(57) ABSTRACT

Provided is a steel sheet for soft-nitriding treatment which has a chemical composition consisting of, in mass %, C: more than or equal to 0.02% and less than 0.07%, Si: less than or equal to 0.10%, Mn: 1.1 to 1.8%, P: less than or equal to 0.05%, S: less than or equal to 0.01%, Al: 0.10 to 0.45%, N: less than or equal to 0.01%, Ti: 0.01 to 0.10%, Nb: 0 to 0.1%, Mo: 0 to 0.1%, V: 0 to 0.1%, Cr: 0 to 0.2%, and the balance: Fe and impurities, satisfies [Mn+Al≥1.5], and has a total content of Ti, Nb, Mo, V, and Cr present as precipitates in the steel sheet of less than 0.03% in mass %. The steel sheet for soft-nitriding treatment has a metal
(Continued)

structure in which a ferrite area ratio is more than or equal to 80%, and a ferrite dislocation density at a position of 50 μm from a surface of the steel sheet is $1\times10^{14}$ to $1\times10^{16}$ $m^{-2}$.

6 Claims, 1 Drawing Sheet

(51) Int. Cl.

| | |
|---|---|
| ***C22C 38/18*** | (2006.01) |
| ***C22C 38/26*** | (2006.01) |
| ***C21D 9/46*** | (2006.01) |
| ***C22C 38/00*** | (2006.01) |
| ***C22C 38/38*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/24*** | (2006.01) |
| ***C22C 38/28*** | (2006.01) |
| *C21D 1/06* | (2006.01) |

(52) U.S. Cl.
CPC ..... *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/18* (2013.01); *C22C 38/22* (2013.01); *C22C 38/24* (2013.01); *C22C 38/26* (2013.01); *C22C 38/28* (2013.01); *C22C 38/38* (2013.01); *C21D 1/06* (2013.01); *C21D 2211/005* (2013.01)

(58) Field of Classification Search
CPC ..... C21D 1/06; C21D 2211/00; C21D 2211/005; C22C 38/00; C22C 38/001; C22C 38/002; C22C 38/02; C22C 38/04; C22C 38/06; C22C 38/12; C22C 38/14; C22C 38/18; C22C 38/22; C22C 38/24; C22C 38/26; C22C 38/28; C22C 38/38
See application file for complete search history.

(56) References Cited

FOREIGN PATENT DOCUMENTS

| | | | |
|---|---|---|---|
| JP | 7-286257 | A | 10/1995 |
| JP | 8-49059 | A | 2/1996 |
| JP | 9-25543 | A | 1/1997 |
| JP | 9-25544 | A | 1/1997 |
| JP | 10-306343 | A | 11/1998 |
| JP | 2002-69572 | A | 3/2002 |
| JP | 2003-105489 | A | 4/2003 |
| JP | 2003-277887 | A | 10/2003 |
| JP | 2004-3010 | A | 1/2004 |
| JP | 2009-68057 | A | 4/2009 |
| JP | 2011-236449 | A | 11/2011 |
| JP | 2012-177176 | A | 9/2012 |
| TW | 201333221 | A1 | 8/2013 |
| WO | WO 2012/070349 | A1 | 5/2012 |
| WO | WO 2012/141297 | A1 | 10/2012 |
| WO | WO 2013/077298 | A1 | 5/2013 |

OTHER PUBLICATIONS

Office Action dated Jul. 17, 2018, in Chinese Patent Application No. 201580031507.6, with English translation.
Extended European Search Report dated Jan. 8, 2018, in European Patent Application No. 15807136.5.
Kurokawa et al., "Soft-Nitriding Steel," The Sumitomo Search, (Sep. 1997), No. 59, pp. 71-73.
Machine English translation of TW 201333221 A1 published Aug. 16, 2013.
Rakhit, A. K., "Heat Treatment for Gears: A Practical Guide for Engineers," Jan. 1, 2000.
International Search Report, issued in PCT/JP2015/007217 (PCT/ISA/210), dated Sep. 15, 2015.
Taiwan Office Action for application No. 104119362 dated Dec. 28, 2915.
Written Opinion of the International Searching Authority, issued in PCT/JP2015/067217 (PCT/ISA/237), dated Sep. 15, 2015.
Machine English translation of CN103221566 A (Jul. 24, 2013).
Office Action dated Nov. 1, 2017, in Chinese Patent Application No. 201580031507.6.

* cited by examiner

STEEL SHEET FOR SOFT-NITRIDING TREATMENT, METHOD OF MANUFACTURING SAME, AND SOFT-NITRIDED STEEL

TECHNICAL FIELD

The present invention relates to a steel sheet for soft-nitriding treatment and a method of manufacturing the same, and in particular, a steel sheet for soft-nitriding treatment which is to be subjected to soft-nitriding treatment after being subjected to press working and a method of manufacturing the same. Further, the present invention relates to a soft-nitrided steel, and in particular, a soft-nitrided steel having excellent press-moldability before nitriding treatment and excellent fatigue resistance after the nitriding treatment.

BACKGROUND ART

Surface hardening treatment is treatment for generating residual stress on a surface of steel to improve abrasion resistance and fatigue resistance simultaneously with hardening the surface of the steel. Examples of method for typical surface hardening treatment that are currently in practical use include carburizing treatment and nitriding treatment.

The carburizing treatment is treatment involving increasing the temperature of the steel to a γ region and diffusing and permeating carbon over the surface of the steel. After the carburizing, quenching is performed to attempt surface hardening. Since the temperature of the steel is increased to the high temperature region in the carburizing treatment, deep hardening can be achieved. However, since it is necessary to perform quenching and tempering after the carburizing, strain is likely to be generated. Therefore, the steel subjected to the carburizing treatment cannot be used for the parts that are used for components accompanying rotation such as a transmission of an automobile. Although the strain can be removed by carrying out special treatment such as press-tempering treatment after the quenching, loss in time and cost accompanied by the special treatment cannot be avoided.

On the other hand, nitriding treatment is treatment involving diffusing and permeating nitrogen at temperature lower than or equal to an $A_1$ point. Since the heating temperature in the nitriding treatment is 500 to 550° C., which is low, so that phase transformation does not occur due to heating, thus, no strain is generated in the steel while it is the case with the carburizing treatment. However, the time taken for the treatment is 50 to 100 hours, which is remarkably long, and it is also necessary to remove a brittle compound layer that has been generated on the surface after the treatment. Also in this case, loss in time and cost cannot be avoided.

Accordingly, there has been developed a method called soft-nitriding treatment. In the soft-nitriding treatment, the steel sheet is heated to temperature lower than or equal to the $A_1$ transformation temperature, and nitrogen is diffused and permeated from the surface of the steel sheet. In this event, by using a carburizing atmosphere, carbon is also additionally diffused and permeated. Since no quenching is necessary as in the case with the carburizing treatment, no strain is generated due to the phase transformation. Further, since the treatment is carried out at relatively low temperature, thermal strain is small. Accordingly, the surface layer of the steel sheet can be hardened without deteriorating precision of a shape of a part. In addition, the time taken for the treatment is approximately half the time taken for the nitriding treatment. Therefore, the soft-nitriding treatment has rapidly been spread widely recently as a method of the surface hardening treatment for parts used in a mechanical structure.

Moreover, the soft-nitriding treatment is often carried out after performing press working to obtain a desired shape of the part. In particular, a part used in a mechanical structure such as a transmission part of an automobile is subjected to the press working from the viewpoint of productivity. Accordingly, a demand is increasing, for a steel sheet for soft-nitriding treatment having excellent moldability which is suitable for a material of a part used in a mechanical structure such as a transmission part of an automobile, and various techniques have been proposed so far.

For example, Patent Literature 1 discloses a method of manufacturing a steel nitride member having excellent cold forgeability and fatigue resistance, and Patent Literature 2 discloses a method of manufacturing a steel nitride member having small strain caused by heat treatment. Further, Patent Literatures 3 and 4 each disclose a steel sheet for nitriding having excellent moldability.

Patent Literature 5 discloses a steel for soft-nitriding treatment whose cost is low and which has satisfactory press workability. Further, Patent Literature 6 discloses a thin steel sheet for nitriding treatment which can obtain, after the nitriding treatment, high surface hardness and sufficient hardening depth. Still further, Patent Literature 7 discloses a steel sheet for soft-nitriding treatment having both excellent processability and fatigue resistance, and Patent Literature 8 discloses a steel sheet for soft-nitriding treatment having excellent moldability and strength stability after the soft-nitriding treatment.

CITATION LIST

Patent Literature

Patent Literature 1: JP H7-286257A
Patent Literature 2: JP H8-49059A
Patent Literature 3: JP H9-25543A
Patent Literature 4: JP H9-25544A
Patent Literature 5: JP 2003-105489A
Patent Literature 6: JP 2003-277887A
Patent Literature 7: JP 2009-68057A
Patent Literature 8: JP 2012-177176A

SUMMARY OF INVENTION

Technical Problem

The steel nitride members disclosed in Patent Literatures 1 and 2 each have the C content of more than or equal to 0.10%, which is high, and also have high Cr and V contents, and therefore have poor processability including elongation. The C content in Patent Literature 3 is 0.01 to less than 0.08%, and the C content in Patent Literature 4 is less than or equal to 0.01%, which are extremely low. However, since the steel sheets disclosed in Patent Literatures 3 and 4 contain large amounts of expensive elements such as Cr and V, there is a problem that manufacturing cost increases.

Further, although Patent Literature 5 evaluates surface hardness, hardening depth, and adhesion bendability after the soft-nitriding treatment, and makes it clear that excellent results are obtained, no examination is carried out for the fatigue resistance of actual parts, and hence, there leaves room for improvement. The technology described in Patent Literature 6 aims to improve durability, however, evaluation is only carried out on surface hardness and hardening depth, and fatigue resistance are not considered sufficiently.

Still further, in each of Patent Literatures 7 and 8, a nitrided layer is hardened by containing Cr as an element for forming a nitride, and strength of a base material is simultaneously adjusted by adding an extremely minute amount of Nb, thereby improving the fatigue resistance. However, the plane bending fatigue strengths of the steel sheets described in Patent Literatures 7 and 8 are approximately 300 to 420 MPa, and there is a problem in that the steel sheets cannot be applied to the parts used in a mechanical structure which are used under a state in which large stress is applied.

The present invention attempts to improve the fatigue resistance which is not sufficiently improved using the conventional technology, and aims to provide a steel sheet for soft-nitriding treatment having both excellent processability and fatigue resistance after the soft-nitriding treatment, and a method of manufacturing the same. Further, the present invention attempts to improve the fatigue resistance which is not sufficiently improved using the conventional technology without reducing productivity and increasing cost, and aims to provide a soft-nitrided steel having excellent processability before the soft-nitriding treatment and also having high fatigue resistance by being subjected to the soft-nitriding treatment.

Solution to Problem

The inventors of the present invention have conducted intensive studies on technology for obtaining a soft-nitrided steel having both excellent processability before the soft-nitriding treatment and fatigue resistance after the soft-nitriding treatment. As a result, the inventors have achieved the following findings.

(a) In order to achieve both the excellent processability before the soft-nitriding treatment and the fatigue resistance after the soft-nitriding treatment, it is necessary to adjust the alloy composition and the metal structure of the steel sheet such that desired surface hardness, hardening depth, and hardness of a base material can be obtained by the soft-nitriding treatment, without deteriorating the moldability before the soft-nitriding treatment.

(b) In order to make the excellent processability of the steel sheet before the soft-nitriding treatment satisfactory, it is necessary to have a metal structure that mainly contains ferrite. The ferrite area ratio can be set to more than or equal to a predetermined amount by causing an appropriate amount of Mn and Al to be contained as composition components of the steel sheet, and appropriately selecting manufacturing conditions in accordance with the composition components.

(c) Precipitation of (Mn, Al) nitrides occurs in the soft-nitriding treatment and sufficient surface hardness can be obtained by adjusting Mn and Al contents within an appropriate range.

(d) It is important to adjust ferrite dislocation density on the surface of the steel sheet in controlling the precipitation of nitride in the soft-nitriding treatment. This is because the precipitation of nitride can be promoted by increasing the ferrite dislocation density on the surface of the steel sheet.

(e) Further, the crystal composition of the nitride that precipitates in this case is $M_3N_2$ (M represents an alloying element) mainly containing Mn. The amount of nitrogen necessary for forming nitride in the case of $M_3N_2$ is smaller than the amount of nitrogen necessary for forming nitride in the case of $M_1N_1$ having another crystal composition. Therefore, nitrogen is diffused deeper in the steel sheet, and thereby making it possible to obtain a large hardening depth.

(f) In addition, by allowing carbides to precipitate inside the steel sheet during the soft-nitriding treatment, the hardness of the base material can be increased owing to precipitation strengthening. Accordingly, it is necessary that Ti, Nb, Mo, V, and Cr, which are elements for forming carbides, be dissolved as a solid solution at more than or equal to a certain amount in the steel sheet before the soft-nitriding treatment.

(g) In order to improve the fatigue resistance after the soft-nitriding treatment, it is important to form a hardened layer having hardness in Vickers hardness at the depth of 50 μm from the outermost surface of the steel of more than or equal to 600 HV, and a hardening depth of more than or equal to 0.35 mm.

(h) In order to obtain desired surface hardness and hardening depth, it is particularly necessary to regulate the content of nitride-forming elements in the steel.

(i) Additionally, as a result of analyzing surface layer parts of various pieces of soft-nitrided steel using a transmission electron microscope (TEM), it has been found that it is necessary to control a precipitation form, a composition, and a number density at a depth position of 50 μm from the outermost surface of the steel, among nitrides formed by the soft-nitriding treatment.

The present invention has been achieved on the basis of the above findings, and the gist of the present invention is to provide the following steel sheet, method of manufacturing the same, and soft-nitrided steel.

[1]

A steel sheet for soft-nitriding treatment which has a chemical composition consisting of, in mass %, C: more than or equal to 0.02% and less than 0.07%,
Si: less than or equal to 0.10%,
Mn: 1.1 to 1.8%,
P: less than or equal to 0.05%,
S: less than or equal to 0.01%,
Al: 0.10 to 0.45%,
N: less than or equal to 0.01%,
Ti: 0.01 to 0.10%,
Nb: 0 to 0.1%,
Mo: 0 to 0.1%,
V: 0 to 0.1%,
Cr: 0 to 0.2%, and
the balance: Fe and impurities, satisfies the following formula (i), and has a total content of Ti, Nb, Mo, V, and Cr present as precipitates in the steel sheet of less than 0.03% in mass %, wherein the steel sheet for soft-nitriding treatment has a metal structure in which a ferrite area ratio is more than or equal to 80%, and a ferrite dislocation density at a position of 50 μm from a surface of the steel sheet is $1\times10^{14}$ to $1\times10^{16}$ $m^{16}$ $m^{-2}$, $$Mn+Al\geq1.5 \quad (i)$$

where each chemical symbol included in the formula represents a content (mass %) of each element contained in the steel sheet.

[2]

The steel sheet for soft-nitriding treatment according to [1], wherein the chemical composition includes, in mass %, one or more selected from Nb: 0.005 to 0.1%,
Mo: 0.005 to 0.1%,
V: 0.005 to 0.1%, and
Cr: 0.005 to 0.2%.

[3]

A method of manufacturing a steel sheet for soft-nitriding treatment, the method including:

starting rolling of a steel raw material having a chemical composition recited in [1] or [2] after the steel raw material is heated to higher than or equal to 1150° C., and ending the rolling at finishing temperature of higher than or equal to 900° C.;

performing coiling, after cooling, in a temperature region of 470 to 530° C. to cause ferrite area ratio to be more than or equal to 80%;

thereafter subjecting the steel raw material to pickling; and subjecting the steel raw material to skin pass rolling after the pickling in conditions in which a rolling reduction ratio is 0.5 to 5.0%, and F/T (mm), is more than or equal to 8000, said F/T(mm) being a ratio of a line load F (kg/mm) determined by dividing a rolling mill load by a width of the steel sheet to a load T (kg/mm$^2$) per unit area applied in a longitudinal direction of the steel sheet.

[4]

A soft-nitrided steel having a chemical composition consisting of, in mass %,

C: more than or equal to 0.02% and less than 0.07%,
Si: less than or equal to 0.10%,
Mn: 1.1 to 1.8%,
P: less than or equal to 0.05%,
S: less than or equal to 0.01%,
Al: 0.10 to 0.45%,
Ti: 0.01 to 0.10%,
Nb: 0 to 0.1%,
Mo: 0 to 0.1%,
V: 0 to 0.1%,
Cr: 0 to 0.2%, and
the balance: Fe and impurities, wherein, at a depth position of 50 μm from an outermost surface, nitrides are precipitated on a {001} plane in a ferrite crystal, an average value of maximum lengths of the respective nitrides is 5 to 10 nm, and a number density of nitrides is more than or equal to $1\times10^{24}$ m$^{-3}$.

[5]

The soft-nitrided steel according to [4], wherein the chemical composition contains, in mass %, one or more selected from Nb: 0.01 to 0.1%,
Mo: 0.01 to 0.1%,
V: 0.01 to 0.1%, and
Cr: 0.01 to 0.2%.

[6]

The soft-nitrided steel according to [4], wherein a Mn concentration in metal elements included in the nitrides is more than or equal to 80 at %.

Note that the "steel sheet for soft-nitriding treatment" according to the present invention includes "steel strip" which is steel in a belt shape. Further, although there is a case where an iron nitride layer having a thickness of approximately several tens of μm is formed on the surface of the steel after the soft-nitriding treatment depending on a surface treatment condition, the "outermost surface of the steel" according to the present invention indicates the surface of the steel that includes the above iron nitride layer.

Advantageous Effects of Invention

According to the present invention, there can be provided the steel sheet for soft-nitriding treatment having excellent press-moldability such as stretch flangeability and hole expandability before the soft-nitriding treatment without deteriorating productivity and economic efficiency. Further, there can be provided the soft-nitrided steel in which a hardened layer having a sufficient thickness from the surface is formed after the soft-nitriding treatment, and which is excellent in fatigue resistance. The steel sheet for soft-nitriding treatment according to the present invention having such characteristics is suitable for being subjected to the soft-nitriding treatment after being processed into a predetermined part shape, and being used as a part for a general structure such as a part for an automobile. Further, the soft-nitrided steel according to the present invention is suitable for being used as a part for a general structure such as a part for an automobile.

Here, the "press working" refers to a processing method that collectively represents deep drawing, bending, ironing, blanking, and the like, and "excellent in press workability" refers to the case in which the press working is capable without applying large strength to the steel material and no cracks or the like occurs which may become substantial defects in the press-molded body in the event of being subjected to press working.

DESCRIPTION OF EMBODIMENTS

Figure 1:
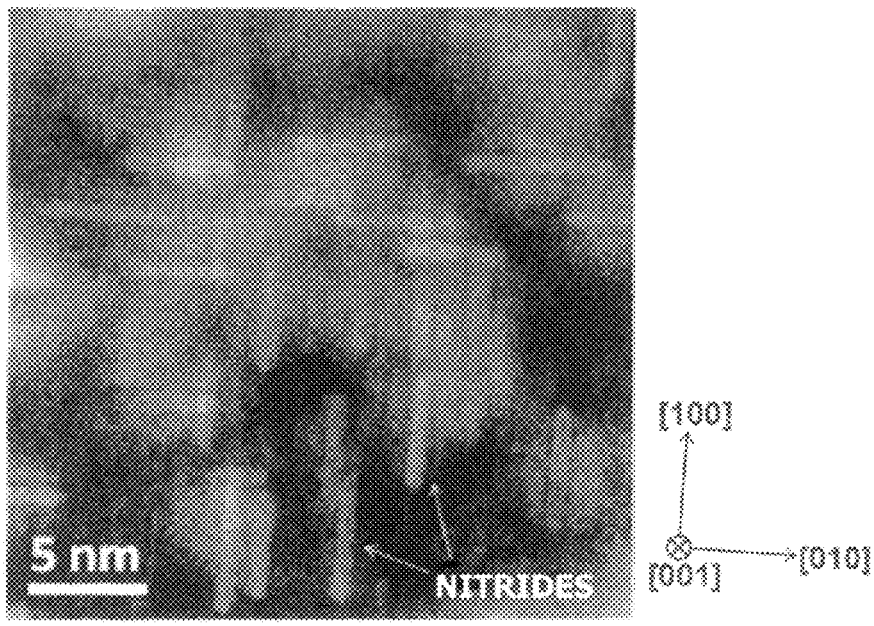
FIG. 1 is a diagram showing an image of nitrides present in ferrite observed using a transmission electron microscope (TEM).

Hereinafter, respective matters of the present invention will be described in detail.

1. Chemical Composition

The reasons for limiting the respective elements are as follows. Note that "%" used for a content in the following description represents "mass %".

C: more than or equal to 0.02% and less than 0.07%

C is an element for improving the strength by being combined with a carbide-forming element and precipitating a carbide, and contributes to improve press workability of the steel and base material hardness after the soft-nitriding treatment. With decrease in the C content, precipitation density of cementite decreases and the press workability improves, but on the other hand, the amount of precipitation of carbides during the soft-nitriding treatment decreases, and sufficient hardness of the base material in the steel sheet cannot be obtained after the soft-nitriding treatment. Accordingly, the C content is more than or equal to 0.02%. On the other hand, in the case where the C content in the steel is more than or equal to 0.07%, the press workability of the steel deteriorates, and hence, the C content is less than 0.07%. The C content is preferably more than or equal to 0.03%, and preferably less than or equal to 0.06%.

Si: less than or equal to 0.10%

Although Si is a useful element as a deoxidizer at a stage of steelmaking process, Si does not contribute to improvement of the surface hardness in the nitriding treatment and decreases the hardening depth. Accordingly, the Si content is less than or equal to 0.10%. The Si content is preferably less than or equal to 0.05%. Note that, in attempting to obtain an effect as the deoxidizer, the Si content is preferably more than or equal to 0.01%.

Mn: 1.1 to 1.8%

Mn has an effect of enhancing the surface hardness by forming a nitride through the soft-nitriding treatment, and is an exceedingly important element in the present invention. When the Mn content is less than 1.1%, the effect of enhancing the surface hardness owing to the nitride formation is not sufficient, the desired hardness distribution cannot be obtained after the soft-nitriding treatment, and hence, it is difficult to obtain satisfactory abrasion resistance and fatigue resistance. On the other hand, when the Mn content exceeds 1.8%, an influence of center segregation becomes notable, and the processability of the steel sheet is deteriorated. Accordingly, the Mn content is 1.1 to 1.8%. The Mn content is preferably more than or equal to 1.2%, and preferably less than or equal to 1.7%.

P: less than or equal to 0.05%

P is an impurity contained in molten iron, segregates at a grain boundary, and is an element that decreases the toughness with increase in the content. Accordingly, the P content is preferably as low as possible. The P content exceeding 0.05% has an adverse effect on the processability, and hence is limited to less than or equal to 0.05%. In particular, taking into account the hole expandability and the weldability, the P content is desirably less than or equal to 0.02%. Note that, since it is difficult to make the P content 0% in terms of operation, 0% is not included.

S: less than or equal to 0.01%

S is an impurity contained in molten iron, and when the content is too much, S not only decreases the toughness and causes a crack in a hot-rolling process, but also deteriorates hole expandability. Accordingly, the S content should be decreased to the utmost. Since the S content is in an acceptable range when it is less than or equal to 0.01%, the S content is limited to less than or equal to 0.01%. Note that, since it is difficult to make the S content 0% in terms of operation, 0% is not included.

Al: 0.10 to 0.45%

Al has an effect of enhancing the surface hardness by forming a nitride through the soft-nitriding treatment, and is an exceedingly important element in the present invention. Accordingly, it is necessary that the Al content be more than or equal to 0.10%. On the other hand, when the Al content exceeds 0.45%, the hardening depth becomes small, and the fatigue resistance is poor. Accordingly, the Al content is 0.10 to 0.45%. The Al content is preferably more than or equal to 0.15%, and preferably less than or equal to 0.40%.

N: less than or equal to 0.01%

When the N content exceeds 0.01% before the soft-nitriding treatment, N combines with Al or Ti in the steel sheet to form a nitride, to thereby deteriorate the processability of the steel sheet. Further, since Ti dissolved as a solid solution in the steel sheet decreases, sufficient hardness of the base material cannot be obtained after the soft-nitriding treatment. Accordingly, the N content is less than or equal to 0.01%. The N content is preferably less than or equal to 0.008%. Note that, after the soft-nitriding treatment, a concentration gradient is generated in the sheet thickness direction owing to the diffusion of N during the treatment. N after the soft-nitriding treatment is dissolved as a solid solution in Fe, and also forms nitride precipitate whose precipitate density depends on the N concentration. Further, the fatigue resistance does not depend on N dissolved as a solid solution, and can be secured when the precipitation density and the size are satisfied. The soft-nitrided steel includes N dissolved as a solid solution in Fe and N forming the nitride precipitate. However, defined in Claims is not the amount of N but only the number density of nitrides. Further, Table 3, which will be described below, describes the amount of N dissolved as a solid solution (EPMA) at a depth position of 50 μm from the surface layer, and makes it understandable that there is no dependence on the amount of N.

Ti: 0.01 to 0.1%

Ti has an effect of enhancing the hardness of the base material by being precipitated as a carbide in the base material during the soft-nitriding treatment, and is an exceedingly important component in the present invention. When the Ti content is less than 0.01%, the above effect is not sufficiently obtained. On the other hand, when the Ti content exceeds 0.1%, heating temperature for solution treatment of titanium carbon nitride in hot-rolling is high and heating temperature increases, which raises manufacturing costs. Therefore, the Ti content is 0.01 to 0.1%. The Ti content is preferably more than or equal to 0.02% and preferably less than or equal to 0.09%.

Nb: 0 to 0.1%

Mo: 0 to 0.1%

V: 0 to 0.1%

Cr: 0 to 0.2%

Nb, Mo, V, and Cr are elements each having an effect of enhancing the hardness of the base material by forming a carbide in the base material during the soft-nitriding treatment. Accordingly, one or more selected from the above elements may be contained. However, when the Nb content, the Mo content, and the V content each exceed 0.1%, and the Cr content exceeds 0.2%, heating temperature for solution treatment of carbon nitride in hot-rolling is high and heating temperature increases, which raises manufacturing costs. Accordingly, it is necessary that the content of each element be less than or equal to 0.1%. In attempting to obtain the above effect, it is preferred that the content of one or more selected from those elements be more than or equal to 0.005%. Note that, in the case where two or more selected from the above elements are contained in a mixed manner, the total content is preferably 0.005 to 0.1%.

$$Mn+Al \geq 1.5 \quad (i)$$

where each chemical symbol included in the formula represents a content (mass %) of each element contained in the steel sheet.

In order to obtain sufficient surface hardness by the soft-nitriding treatment, it is not sufficient that the contents of the respective elements be in the above-defined ranges, respectively, and it is necessary that the above formula (i) be satisfied. It is because the surface hardness cannot be enhanced sufficiently if the amount of precipitation of (Mn, Al) nitride formed in the soft-nitriding treatment is small.

The steel material according to the present invention has a chemical composition comprising the above-mentioned elements from C to Cr, and the balance of Fe and impurities.

The "impurities" represent components that are mixed due to various factors of manufacturing processes and of raw materials such as ores and scraps in industrially manufacturing the steel sheet, and indicate those which are allowed to be contained in a range that do not adversely affect the present invention.

Total content of Ti, Nb, Mo, V, and Cr present as precipitates in steel sheet for soft-nitriding treatment before soft-nitriding treatment: less than 0.03%

In the present invention, the total content of Ti, Nb, Mo, V, and Cr present as precipitates in the steel is an important index from the viewpoint of improving the fatigue resistance of the steel sheet after the soft-nitriding treatment. In order to make the fatigue resistance satisfactory, not only the hardness of the surface of the steel sheet (surface hardness), but also the hardness of the inside of the steel sheet (hardness of the base material) should be high. By causing carbides to precipitate inside the steel sheet during the soft-nitriding treatment, it is possible to make the hardness of the base material high owing to precipitation strengthening. Accordingly, it is necessary that Ti, Nb, Mo, V, and Cr, which are elements for forming carbides, be dissolved as a solid solution at more than or equal to a certain amount in the steel sheet for soft-nitriding treatment.

When the total content of Ti, Nb, Mo, V, and Cr present as precipitates is, in mass %, more than or equal to 0.03%, the solid solution concentration decreases, sufficient precipitation strengthening cannot be obtained, the hardness of the base material decreases, and the fatigue resistance also deteriorates. Therefore, in the present invention, the total content of Ti, Nb, Mo, V, and Cr included in the precipitates present in the steel sheet is, in mass %, less than 0.03%.

Note that the content of each of Ti, Nb, Mo, V, and Cr, which are present as precipitates, is determined using the following extraction residue analysis. A test piece is collected from the steel sheet for soft-nitriding treatment, is immersed in an electrolytic solution (10% of acetylacetone, 1% of tetramethylammonium chloride, and the balance of methanol), is subjected to constant-current electrolysis, and is then caused to filter through a filter having a filtration diameter of 0.2 μm to obtain an extraction residue (carbide). After dissolving the extraction residue to obtain a solution, the solution is analyzed using inductively coupled plasma optical emission spectrometry (ICP-OES), and the concentrations of Ti, Nb, Mo, V, and Cr in the solution are each measured. Then, the measured concentrations are each divided by the mass of the electrolyzed test piece to thereby calculate the content of each of Ti, Nb, Mo, V, and Cr, which are present as precipitates in the steel sheet.

2. Metal Structure of Steel Sheet for Soft-nitriding Treatment Before Soft-nitriding Treatment In addition to the above composition component, the steel sheet according to the present invention has a metal structure in which a ferrite area ratio is more than or equal to 80%, and a ferrite dislocation density at a position of 50 μm from a surface of the steel sheet is $1\times10^{14}$ to $1\times10^{16}$ $m^{-2}$.

Ferrite area ratio: more than or equal to 80%

In the present invention, the ferrite area ratio is an important index for making the processability of the steel sheet satisfactory. If metal structures other than the ferrite is contained and the ferrite area ratio becomes less than 80%, it becomes difficult to achieve both the elongation and the hole expandability of the steel sheet. The other metal structures include austenite, pearlite, bainite, and martensite. Further, in order to achieve the strength, the elongation, and the hole expandability in proper balance, the ferrite grain size is desirably less than 20 μm.

Ferrite dislocation density at position of 50 μm from surface of steel sheet: $1\times10^{14}$ to $1\times10^{16}$ $m^{-2}$ The ferrite dislocation density at a position of 50 μm from the surface of the steel sheet is an exceedingly important index for controlling precipitation of a nitride in the soft-nitriding treatment. When the dislocation density of the steel sheet surface layer is increased, nitride is preferentially produced on the dislocation, the precipitation can be promoted, and the surface hardness can be increased. However, when the dislocation density of the steel sheet surface layer is too high, the processability deteriorates and it becomes difficult to be formed into a shape of a part. Accordingly, in the present invention, the dislocation density at the position of 50 μm from the surface of the steel sheet is more than or equal to $1\times10^{14}$ $m^{-2}$ in order to obtain sufficient surface hardness in the soft-nitriding treatment, and is less than or equal to $1\times10^{16}$ $m^{-2}$ in order to secure the excellent processability of the steel sheet.

In the event of increasing the ferrite dislocation density of the surface of the steel sheet, if the dislocation is introduced up to the center in the sheet thickness direction, the processability may deteriorate. Accordingly, it is desirable that the dislocation density at the center in the sheet thickness direction be not increased.

The dislocation density can be determined as follows. After subjecting the steel sheet to mechanical polishing, the steel sheet is further polished up to a predetermined position in the sheet thickness direction through electrolytic polishing. Lattice strain ε is calculated using Williamson-Hall plot from peak integrated intensity of {110}, {211}, {220} obtained by an X-ray diffraction method, and after that, dislocation density ρ is calculated on the basis of the following formula. Here, b represents a Burgers vector.

$$\rho=(14.4\times\varepsilon^2)/b^2$$

Williamson-Hall plot is disclosed in a known document "Tetsu-to-Hagane, Vol. 100 (2014) No. 10 Tanaka et al.", for example.

3. Nitride of Soft-nitrided Steel After Soft-nitriding Treatment

As described above, in order to improve the fatigue resistance of the soft-nitrided steel, it is important to form a hardened layer having hardness in Vickers hardness in the case of setting test force to 0.3 kgf at the depth position of 50 μm from the outermost surface of the steel of more than or equal to 600 HV, and a hardening depth or more than or equal to 0.35 mm. For forming such a hardened layer, it is necessary that in the soft-nitrided steel of the present invention, plate-like nitrides be precipitated on a {001} plane in a ferrite crystal at least at a depth position of 50 μm from an outermost surface. In addition, it is necessary that the precipitation form, the composition, and the number density of the above nitrides be defined as shown below.

Since the nitrides precipitated on the {001} plane in the ferrite crystal each have a plate-like shape, the nitrides generate large coherency strain in ferrite crystal lattice, and effectively act on hardness increasing. In order to exhibit this action effectively, it is necessary that the maximum length of a nitride be 5 to 10 nm. When the maximum length is less than 5 nm, sufficiently large coherency strain cannot be generated in the ferrite crystal lattice. On the other hand, when the maximum length exceeds 10 nm, the incoherency increases, and hence, the hardness lowers.

Further, the nitrides that precipitates by the nitriding treatment in the present invention contain Mn, Al, and N as main components, and each show a crystal composition of $(Mn, Al)_xN_y$. In the case where a nitride present in the soft-nitrided steel precipitates as $(Mn, Al)_3N_2$ having a crystal structure of $\eta$-$Mn_3N_2$ type, the Mn concentration in the metal elements including Mn and Al forming the nitride is more than or equal to 80at %. This nitride uses, compared to $(Mn, Al)_1N_1$ having a crystal structure of NaCl type, small amount of precipitated N which has entered from the surface of the steel and dissolved as a solid solution. Therefore, N enters up to a deeper position during the same time period of soft-nitriding treatment, and the hardening depth increases. Accordingly, the Mn concentration in metal elements included in the nitride present at a depth position of 50 μm from the outermost surface is more than or equal to 80 at %.

Conventionally, it has been considered that Mn only has a weak action as an element for forming nitrides. However, by being contained by a predetermined amount in the steel with Al having a strong action on forming nitrides, the formation of nitrides mainly containing Mn and Al is promoted. Those nitrides do not show much action that inhibits the diffusion of nitrogen inside after forming only on the surface of a pole. Accordingly, it becomes possible to effectively form nitrides up to sufficiently deep region from the surface of the steel, and thereby making it possible to obtain a large hardening depth.

Additionally, in order to obtain a predetermined hardness at the depth position of 50 μm from the outermost surface of the steel, it is necessary that the nitrides each having the above-mentioned precipitation form be dispersed in high density in the surface layer. Accordingly, the number density of nitrides is more than or equal to $1\times10^{24}$ $m^{-3}$. Further, in order to increase the improvement of the fatigue resistance owing to the hardening of the surface layer, the number density of nitride is preferably more than or equal to $2\times10^{24}$ $m^{-3}$.

Note that, the maximum length of a nitride and the number density of nitrides at the depth position of 50 μm from the outermost surface of the steel can be determined by, for example, observing and analyzing precipitates in the hardened layer of the surface layer using a TEM. The TEM observation is desirably carried out in the condition that a [001] direction of ferrite is parallel to an incident direction of an electron beam. Further, the maximum length is desirably evaluated using an average value of nitrides included in an observed visual field. Note that it is preferred that, regarding nitrides, five visual fields be imaged, each visual field having an area of 50 nm×50 nm, at least 50 nitrides in total be extracted, and the average value be determined.

In determining the number density of nitrides, the nitrides precipitated on the {001} plane in a ferrite crystal can be determined by counting the number of nitrides on a (001) plane, the number of nitrides on a (100) plane, and the number of nitrides on a (010) plane, and totalizing the numbers. However, if it is difficult to observe the nitrides precipitated on the (001) plane, the determination can be performed by counting the number of nitrides on the (100) plane and the number of nitrides on the (010) plane, and multiplying the total number by 1.5. Further, the thickness of a TEM sample of the observed region can be measured by using a log-ratio method of electron energy loss spectroscopy (EELS). The number density can be determined by dividing the observed number of nitrides by a volume, the volume being determined by multiplying the area of the observed visual field by the thickness. In calculating the number density, it is preferred that at least five visual fields be imaged from different crystal grains at 1000000 to 2000000-fold magnification, the number densities be determined in the respective visual fields, and an average value of the number densities determined in the respective visual fields be employed.

Further, in the present invention, regarding the Mn concentration in metal elements included in the nitrides, the value determined by an element analysis using TEM energy dispersion x-ray spectroscopy (TEM-EDS) is employed.

Note that a sample to be served for the TEM observation may be prepared by a general TEM sample preparation method such as electrolytic polishing, FIB lift-out, and Ar-ion polishing.

4. Manufacturing Method

The method of manufacturing the steel sheet for soft-nitriding treatment according to the present invention is not particularly limited, and, for example, the steel sheet for soft-nitriding treatment according to the present invention can be manufactured by subjecting the steel raw material having the above chemical composition to the following treatment.

The steel raw material is heated to higher than or equal to 1150° C., and after that, rolling is started. The rolling is ended at finishing temperature of higher than or equal to 900° C. By heating the slab in a heating furnace to have the before-rolling heating temperature of higher than or equal to 1150° C., precipitation elements contained in the steel can be sufficiently subjected to solution treatment. Note that since the austenite grain size becomes coarse when the heating temperature exceeds 1300° C., the heating temperature is preferably lower than or equal to 1300° C. Further, when the rolling finishing temperature is lower than 900° C., the deformation resistance becomes high and a load on the rolling mill increases.

After the rolling, cooling is performed, and then coiling is performed in a temperature region of 470 to 530° C. Note that, during the period from after the rolling to the coiling, in the time period within 4.0 seconds from the start of the cooling, the cooling is preferably performed in the condition that a cooling rate CR (° C./s) satisfies the following formula (iii), the formula (iii) having a relationship with a value of CeqIIW defined in the following formula (ii), $$CeqIIW=C+Mn/6+(Cr+Mo+V)/5 \quad (ii)$$

$$80-190\times CeqIIW\leq CR\leq 115-230\times CewIIW \quad (iii)$$

where each chemical symbol included in the formula represents a content (mass %) of each element contained in the steel sheet.

This is because: when the cooling rate CR (° C./s) in the cooling process is too low, it may be difficult to suppress precipitation of carbides in high temperature during cooling; and when the cooling rate CR (° C./s) in the cooling process is too high, the transformation temperature becomes too low, the bainite transformation is carried out, and the ferrite area ratio decreases, and hence, the strength of the steel sheet increases, and the processability may deteriorate.

In order to prevent deterioration in moldability due to formation of low temperature transformation structures of martensite and bainite, the coiling temperature is preferably higher than or equal to 470° C. On the other hand, when the coiling temperature exceeds 530° C., the precipitation of carbides in ferrite progresses and the carbides become coarse in the subsequent soft-nitriding treatment, therefore, the hardness of the base material decreases. Accordingly, the coiling temperature is preferably 470 to 530° C.

After the steel sheet is cooled, the steel sheet is subjected to pickling. The pickling aims to remove scales on the surface of the steel sheet, and may be performed using a known method.

The steel sheet after having been subjected to the pickling is then subjected to skin pass rolling. An object of the skin pass rolling is not only to suppress yield elongation by introducing a mobile dislocation, but also to increase the dislocation density of the surface of the steel sheet.

A rolling reduction ratio in the skin pass rolling is preferably 0.5 to 5.0%. This is because: when the rolling reduction ratio is less than 0.5%, the yield elongation is not necessarily be suppressed; and when the rolling reduction ratio exceeds 5.0%, the dislocation is introduced up to the center in the sheet thickness direction and ductility may deteriorate.

Further, regarding the skin pass rolling, it is desirable that F/T (mm), which is a ratio of a line load F (kg/mm) determined by dividing a rolling mill load by a width of the steel sheet to a load T (kg/mm$^2$) per unit area applied in a longitudinal direction of the steel sheet, be more than or equal to 8000. This is because, when F/T is less than 8000, increase in the dislocation density of the steel sheet surface layer is small and the effect of promoting precipitation of nitrides during the soft-nitriding treatment is not sufficient, and hence, desired surface hardness is not necessarily be obtained.

Next, there will be described a preferable treatment condition for subjecting the steel material for nitriding treatment obtained using the above manufacturing method to the nitriding treatment. Usually, after the steel material for nitriding treatment is press-molded into a part for an automobile or a part for a mechanical structure, the part is subjected to the soft-nitriding treatment, thereby hardening the surface layer. The method of manufacturing the soft-nitrided steel according to the present invention is not particularly limited, and, for example, the soft-nitrided steel can be manufactured by subjecting the steel material for soft-nitriding treatment obtained by the above manufacturing method to the soft-nitriding treatment whose treatment condition is adjusted, and causing the nitrides having a predetermined precipitation form to be produced up to a target depth. Note that, from the viewpoint of quality and manufacturing cost, it is preferred that a method for gas soft-nitriding treatment be employed as the method for soft-nitriding treatment.

The gas soft-nitriding treatment is preferably performed in the gas atmosphere of $NH_3$:$N_2$:$CO_2$, the heating temperature of 560 to 580° C., and the treatment time of one to three hours. Setting higher heating temperature during the soft-nitriding treatment and increasing the treatment time period lead to decrease in the productivity and increase in the cost. Further, the precipitated nitrides become coarse, the generation of coherency strain in ferrite crystal lattice is inhibited, and incoherency appears, which may cause decrease in the hardness. Accordingly, it is preferred that the soft-nitriding treatment be performed in low heating temperature and short treatment time from the viewpoint of increasing the productivity and reducing the cost.

With the use of the above method, the nitrides having the above-mentioned precipitation form can be produced in high density over a sufficient depth range from the surface layer. Of course, the soft-nitriding treatment is not necessarily limited to the above-mentioned gas soft-nitriding treatment, and may be any treatment as long as the surface layer hardened layer defined in the present invention can be formed by adjusting conditions for subjecting the steel material having the composition component defined in the present invention to the soft-nitriding treatment.

EXAMPLES

Hereinafter, although the present invention will be described more specifically by way of examples, the present invention is not limited to those examples.

Pieces of steel each having a chemical composition shown in Table 1 were melted and casted to obtain steel raw materials. Those steel raw materials were subjected to hot-rolling in the conditions shown in Table 2, to thereby be manufactured into steel sheets. After that, scales were removed in an aqueous 7% hydrochloric acid solution, the skin pass rolling was performed in the conditions shown in Table 2, and steel sheets each having a thickness of 2.9 mm were manufactured.

TABLE 1

| | Chemical composition (mass %, balance: Fe and impurities) | | | | | | | | | | | | | Right side value of | Leftmost side value | Rightmost side value |
|---|---|---|---|---|---|---|---|---|---|---|---|---|---|---|---|---|
| Steel | C | Si | Mn | P | S | Al | N | Ti | Nb | Mo | V | Cr | Mn + Al | Formula (II)† | of Formula (III)‡ | of Formula (III)‡ |
| A | 0.005* | 0.04 | 1.26 | 0.008 | 0.0030 | 0.32 | 0.0036 | 0.07 | | | | | 1.58 | 0.22 | 39 | 65 |
| B | 0.04 | 0.09 | 0.60* | 0.007 | 0.0036 | 0.38 | 0.0017 | 0.05 | | | | | 0.98 | 0.14 | 53 | 83 |
| C | 0.03 | 0.01 | 2.30* | 0.008 | 0.0031 | 0.28 | 0.0040 | 0.05 | | | | | 1.58 | 0.41 | 1 | 20 |
| D | 0.05 | 0.01 | 1.28 | 0.008 | 0.0050 | 0.03* | 0.0014 | 0.07 | | | | | 1.58 | 0.26 | 30 | 54 |
| E | 0.04 | 0.05 | 1.45 | 0.007 | 0.0035 | 0.70* | 0.0036 | 0.06 | | | | | 1.58 | 0.28 | 26 | 50 |
| F | 0.03 | 0.06 | 1.32 | 0.006 | 0.0024 | 0.29 | 0.0025 | 0.003* | | | | | 1.61 | 0.25 | 33 | 58 |
| G | 0.05 | 0.06 | 1.30 | 0.008 | 0.0021 | 0.33 | 0.0050 | 0.05 | | | | | 1.63 | 0.27 | 29 | 54 |
| H | 0.06 | 0.07 | 1.66 | 0.008 | 0.0027 | 0.22 | 0.0016 | 0.05 | | | 0.01 | 0.01 | 1.88 | 0.34 | 15 | 37 |
| I | 0.04 | 0.04 | 1.54 | 0.007 | 0.0031 | 0.20 | 0.0015 | 0.07 | 0.02 | | | | 1.78 | 0.30 | 24 | 47 |
| J | 0.05 | 0.05 | 1.50 | 0.008 | 0.0044 | 0.19 | 0.0026 | 0.04 | | 0.01 | 0.01 | | 1.68 | 0.30 | 22 | 45 |

*Out of range defined in present invention

†OeqIIW = C + Mn/6 + (Cr + Mo + V)5 (II)

‡80-190 × OeqIIW ≤ OR ≤ 115-230 × OewIIW (III)

TABLE 2

| Test No. | Steel | Rolling conditions: Heating temperature (° C.) | Rolling conditions: Finishing temperature (° C.) | Cooling conditions: Cooling rate (° C./s) | Cooling conditions: Winding temperature (° C.) | Skin pass rolling conditions: Rolling reduction ratio (%) | Skin pass rolling conditions: F#1 (kg/mm) | Skin pass rolling conditions: T#2 (kg/mm$^2$) | Skin pass rolling conditions: F/T (mm) |
|---|---|---|---|---|---|---|---|---|---|
| 1 | A* | 1250 | 940 | 45 | 500 | 1.2 | 1028 | 0.112 | 9162 |
| 2 | B* | 1230 | 950 | 60 | 500 | 1.2 | 1000 | 0.109 | 9156 |
| 3 | C* | 1230 | 920 | 10 | 500 | 1.2 | 964 | 0.112 | 8593 |
| 4 | D* | 1240 | 930 | 45 | 500 | 1.2 | 1013 | 0.108 | 9338 |
| 5 | E* | 1250 | 920 | 40 | 500 | 1.2 | 958 | 0.108 | 8856 |
| 6 | F* | 1250 | 930 | 45 | 500 | 1.2 | 964 | 0.110 | 8721 |
| 7 | G | 1240 | 940 | 35 | 500 | 1.2 | 968 | 0.111 | 8680 |
| 8 | H | 1250 | 950 | 25 | 500 | 1.2 | 996 | 0.113 | 8840 |
| 9 | I | 1250 | 920 | 35 | 500 | 1.2 | 1072 | 0.108 | 9929 |
| 10 | J | 1240 | 930 | 30 | 500 | 1.2 | 1072 | 0.113 | 9479 |
| 11 | G | 1050 | 920 | 40 | 500 | 1.2 | 985 | 0.105 | 9341 |
| 12 | G | 1230 | 930 | 10 | 500 | 1.2 | 1033 | 0.114 | 9081 |
| 13 | G | 1230 | 920 | 70 | 500 | 1.2 | 1024 | 0.111 | 9227 |
| 14 | G | 1240 | 940 | 40 | 400 | 1.2 | 1070 | 0.107 | 10025 |
| 15 | G | 1250 | 930 | 40 | 600 | 1.2 | 1057 | 0.112 | 9433 |
| 16 | G | 1250 | 920 | 40 | 500 | 1.2 | 870 | 0.115 | 7580 |

*Out of range defined in present invention

#1Line load determined by dividing rolling mill load by width of steel sheet

#2Load per unit area applied in longitudinal direction of steel sheet

First, a test piece to be used for measuring a ferrite area ratio was cut out from the steel sheet using a cutting machine. After that, a cross section that is perpendicular to the rolling direction was subjected to mechanical polishing to obtain a mirror-finished surface, and then a structure was revealed with nital corrosion. Using an optical microscope, at a ¼ position in the sheet thickness direction, five visual fields of a range of 90 μm in the sheet thickness direction and 120 μm in the rolling direction were observed at 1000-fold magnification, and the value determined by dividing all ferrite areas in the imaged visual fields by whole area that had been imaged was employed as the ferrite area ratio.

Next, a test piece to be served for dislocation density measurement was cut out from the steel sheet using a cutting machine, and then was molded into a size of 10 mm by 10 mm by an electro-discharge process. After the surface was subjected to mechanical polishing to obtain a mirror-finished surface, a strained layer introduced by the mechanical polishing was removed by electrolytic polishing, and the polishing was performed up to the depth position of 50 μm from the surface of the steel sheet. Lattice strain ε was calculated using Hall plot from peak integrated intensity of {110}, {211}, {220} obtained by an X-ray diffraction method, and after that, dislocation density ρ is calculated on the basis of the following formula. Here, b represents a Burgers vector, and is set to $0.25\times10^{-9}$ m.

$$\rho=(14.4\times\varepsilon^2)/b^2$$

Further, a test piece for evaluating precipitates was collected from the steel sheet, and was served for extraction residue analysis. The collected test piece was immersed in an electrolytic solution (10% of acetylacetone, 1% of tetramethylammonium chloride, and the balance of methanol), was subjected to constant-current electrolysis, and was then caused to filter through a filter having a filtration diameter of 0.2 μm to obtain an extraction residue (carbide). After dissolving the extraction residue to obtain a solution, the solution was analyzed using inductively coupled plasma optical emission spectrometry (ICP-OES), and the concentrations of Ti, Nb, Mo, V, and Cr in the solution were each measured. Additionally, the measured concentrations were each divided by the mass of the electrolyzed test piece to thereby calculate the content of each of Ti, Nb, Mo, V, and Cr, which were present as precipitates in the steel sheet.

Then, a JIS No. 5 tensile test piece having the rolling direction as the tensile direction is collected from the steel sheet, a tensile test in accordance with JIS Z 2241 (2011) was performed, and tensile strength (TS) and elongation at break (El) were measured. Further, a hole expansion test using a 60° conical punch was performed, and a hole expansion rate (λ) was measured.

Next, a test piece for measuring hardness and a test piece for plane bending were collected from the steel sheet, those test pieces were subjected to gas soft-nitriding treatment involving being retained in temperature of 570° C. in atmosphere gas of $NH_3$:$N_2$:$CO_2$=50:45:5 for two hours, and then being oil-cooled at oil temperature of 80° C.

Using the test piece for measuring hardness, measurement of Vickers hardness was performed at a position of 50 μm from the surface of the steel sheet after the soft-nitriding treatment and at a sheet thickness central portion. The test condition was set to the test force of 0.3 kgf (2.942 N), and the average value of the measurement results of five points was determined. The hardness at the position of 50 μm from the surface of the steel sheet was set as surface hardness, and the hardness of the sheet thickness central portion was set as the hardness of the base material. Further, the distance from the surface of the steel sheet to the depth at which the hardness is greater by 50 HV than the hardness of the base material was set as the hardening depth.

The fatigue resistance was evaluated in accordance with test of plane bending fatigue testing of metal plates described in JIS Z 2275 (1978) using a Schenck type plane bending fatigue testing machine. The frequency was set to 25 Hz, the stress ratio was set to R=−1, and the fatigue strength was evaluated at number of repetitions of $10^7$ cycles time strength.

Table 3 shows the ferrite area ratio, the dislocation density, the total content of Ti, Nb, Mo, V, and Cr present as precipitates, the measurement results of mechanical characteristics, and the evaluation results of fatigue resistance. Note that, in the present Examples, the processability was evaluated as satisfactory when El was more than or equal to 25% and λ was more than or equal to 120%. Further, the hardening characteristics was evaluated as satisfactory when the surface hardness was more than or equal to 600 HV, the hardness of the base material is more than or equal to 180 HV, and the hardening depth is more than or equal to 0.35 mm. In addition, regarding the plane bending fatigue testing, when the fatigue strength was more than or equal to 600 MPa, the fatigue resistance was set as satisfactory (A), and when the fatigue strength was less than 600 MPa, the fatigue resistance was set as poor (B).

TABLE 3

| Test Contents | | Features and characteristics before nitriding treatment | | | | | |
|---|---|---|---|---|---|---|---|
| | | | Microstructure | | Mechanical characteristics | | |
| Test No. | Steel | Content of alloy elements in precipitate[#3] | Ferrite area ratio (%) | Dislocation density ($m^{-2}$)[#4] | TS(MPa) | El(%) | λ (%) |
| 1 | A | 0.012 | 94 | $8.9 \times 10^{14}$ | 504 | 33 | 130 |
| 2 | B | 0.010 | 84 | $1.4 \times 10^{15}$ | 540 | 29 | 135 |
| 3 | C | 0.015 | 83 | $1.3 \times 10^{15}$ | 645 | 24 | 97 |
| 4 | D | 0.011 | 87 | $8.0 \times 10^{14}$ | 608 | 27 | 135 |
| 5 | E | 0.013 | 84 | $4.2 \times 10^{14}$ | 612 | 27 | 130 |
| 6 | F | 0.003 | 81 | $9.3 \times 10^{14}$ | 622 | 26 | 123 |
| 7 | G | 0.013 | 91 | $1.2 \times 10^{15}$ | 624 | 27 | 124 |
| 8 | H | 0.014 | 82 | $6.4 \times 10^{14}$ | 653 | 26 | 132 |
| 9 | I | 0.011 | 83 | $1.1 \times 10^{15}$ | 640 | 26 | 130 |
| 10 | J | 0.014 | 84 | $1.8 \times 10^{15}$ | 631 | 27 | 122 |
| 11 | G | 0.039 | 81 | $1.7 \times 10^{15}$ | 594 | 26 | 115 |
| 12 | G | 0.042 | 87 | $3.6 \times 10^{14}$ | 581 | 27 | 121 |
| 13 | G | 0.012 | 56 | $1.1 \times 10^{16}$ | 674 | 21 | 107 |
| 14 | G | 0.011 | 62 | $7.0 \times 10^{15}$ | 657 | 22 | 114 |
| 15 | G | 0.032 | 87 | $4.6 \times 10^{14}$ | 643 | 26 | 124 |
| 16 | G | 0.013 | 83 | $6.3 \times 10^{13}$ | 614 | 27 | 124 |

| Test Contents | | Features and characteristics after nitriding treatment | | | | | | |
|---|---|---|---|---|---|---|---|---|
| | | Nitrides[#5] | | Mechanical characteristics after nitriding treatment | | | | |
| Test No. | Steel | Number density of nitrides ($m^{-3}$) | Size of nitride (nm) | Surface layer hardness (Hv) | Hardening depth (mm) | Base material hardness (Hv) | Fatigue resistance | |
| 1 | A | $2.2 \times 10^{24}$ | 6 | 668 | 0.41 | 138 | B | Comparative Example |
| 2 | B | $0.79 \times 10^{23}$ | 4 | 456 | 0.39 | 184 | B | Comparative Example |
| 3 | C | $3.1 \times 10^{24}$ | 8 | 735 | 0.35 | 211 | A | Comparative Example |
| 4 | D | $0.77 \times 10^{23}$ | 7 | 512 | 0.43 | 201 | B | Comparative Example |
| 5 | E | $3.9 \times 10^{24}$ | 9 | 701 | 0.30 | 211 | B | Comparative Example |
| 6 | F | $2.3 \times 10^{24}$ | 8 | 619 | 0.40 | 134 | B | Comparative Example |
| 7 | G | $2.4 \times 10^{24}$ | 8 | 634 | 0.39 | 210 | A | Example |
| 8 | H | $3.2 \times 10^{24}$ | 8 | 710 | 0.38 | 236 | A | Example |
| 9 | I | $3.1 \times 10^{24}$ | 8 | 674 | 0.38 | 224 | A | Example |
| 10 | J | $2.0 \times 10^{24}$ | 9 | 623 | 0.40 | 216 | A | Example |
| 11 | G | $2.2 \times 10^{24}$ | 5 | 617 | 0.39 | 154 | B | Comparative Example |
| 12 | G | $1.9 \times 10^{24}$ | 4 | 613 | 0.38 | 146 | B | Comparative Example |
| 13 | G | $2.7 \times 10^{24}$ | 17 | 657 | 0.38 | 221 | B | Comparative Example |
| 14 | G | $2.6 \times 10^{24}$ | 7 | 634 | 0.37 | 213 | A | Comparative Example |
| 15 | G | $2.5 \times 10^{24}$ | 6 | 628 | 0.38 | 157 | B | Comparative Example |
| 16 | G | $0.7 \times 10^{24}$ | 4 | 512 | 0.41 | 183 | B | Comparative Example |

Those which are out of range defined in present invention are each underlined.

[#3]Total content of Ti, Nb, Mo, V, and Cr present as precipitates

[#4]Dislocation density at position 50 μm from surface of steel sheet

[#5]Nitrides at position 50 μm from steel sheet surface layer after soft-nitriding treatment As it is clear from Table 3, Test Nos. 1 to 6, which were Comparative Examples whose chemical compositions deviate from the chemical composition defined in the present invention, each had a result in which the processability or the fatigue resistance was poor. Test No. 1 had low C content, so the amount of precipitation of carbides during the gas soft-nitriding treatment was small, and hence the hardness of the base material was low, and the fatigue resistance was also poor. Test No. 2 had low Mn content, so the precipitation of Mn-nitride in the gas soft-nitriding was insufficient, and hence the surface hardness was low, and the fatigue resistance was poor. Test No. 3 had high Mn content, center segregation of the steel sheet was notable, and the processability was poor. Test No. 4 had low Al content, so the precipitation of Al-nitride was insufficient, and hence, the surface hardness was low and the fatigue resistance was poor. Test No. 5 had high Al content, so the hardening depth became small, and the fatigue resistance was poor. Test No. 6 had low Ti content, so the amount of precipitation of carbides during the gas soft-nitriding treatment was small. Therefore, the hardness of the base material was low, and the fatigue resistance was poor.

Test Nos. 11 to 16, which are Comparative Examples whose chemical compositions satisfy the chemical composition defined in the present invention while whose metal structures deviate from the metal structure defined from the present invention, each had a result in which the processability or the fatigue resistance was poor. Test No. 11 had low heating temperature, and Ti could not be sufficiently subjected to solution treatment. Therefore, the precipitation of carbides during the gas soft-nitriding was small, the hardness of the base material was poor, and as a result, the fatigue resistance was poor. Test No. 12 had slow cooling rate, and carbides precipitated during cooling. Therefore, the precipitation of carbides in the base material during the gas soft-nitriding was insufficient, the hardness of the base material was poor, and as a result, the fatigue resistance was poor. Test No. 13 had fast cooling rate, a bainite structure was formed, and the ferrite area ratio decreased. Therefore, the processability was poor. Test No. 14 had low coiling temperature, a low temperature transformation structure such as bainite or martensite was formed, and the ferrite area ratio decreased. Therefore, the processability was poor. Test No. 15 had high coiling temperature, and the precipitation of carbides was promoted during the coiling. Therefore, the carbides become coarse during the gas soft-nitriding treatment, the hardness of the base material was poor, and as a result, the fatigue resistance was poor. Test No. 16 had a small F/T value, which is a condition of the skin pass rolling, so the dislocation density of the steel sheet surface layer did not increase sufficiently. Therefore, the surface hardness in the gas soft-nitriding treatment was low, and as a result, the fatigue resistance was poor.

On the other hand, it was found that Test Nos. 7 to 10, which are Examples that satisfy all requirements of the present invention, each exhibited satisfactory hardening characteristics, and each had hardness of the base material that increased sufficiently by the gas soft-nitriding treatment, and hence had both satisfactory processability and fatigue resistance.

Next, pieces of steel each having a chemical composition shown in Table 4 were dissolved to produce ingots. Those ingots were heated at 1250° C. for one hour, and then subjected to hot-rolling in the conditions that the finishing temperature was 900° C. and the finishing thickness was 3 mm. Then, after performing coiling at the temperature of 500° C., scales were removed in an aqueous 7% hydrochloric acid solution, and steel sheets were manufactured.

TABLE 4

| | Chemical composition (mass %, balance: Fe and impurities) | | | | | | | | | | |
|---|---|---|---|---|---|---|---|---|---|---|---|
| Steel | C | Si | Mn | P | S | Al | Ti | Nb | Mo | V | Cr |
| A | 0.004* | 0.03 | 1.30 | 0.008 | 0.0026 | 0.34 | 0.06 | — | — | — | — |
| B | 0.05 | 0.02 | 0.52* | 0.009 | 0.0031 | 0.37 | 0.05 | — | — | — | — |
| C | 0.03 | 0.01 | 2.13* | 0.008 | 0.0038 | 0.30 | 0.07 | — | — | — | — |
| D | 0.04 | 0.04 | 1.43 | 0.007 | 0.0042 | 0.03* | 0.05 | — | — | — | — |
| E | 0.05 | 0.05 | 1.31 | 0.009 | 0.0028 | 1.00* | 0.06 | — | — | — | — |
| F | 0.05 | 0.03 | 1.43 | 0.006 | 0.0041 | 0.38 | 0.003* | — | — | — | — |
| G | 0.04 | 0.04 | 1.37 | 0.007 | 0.0036 | 0.23 | 0.05 | — | — | — | — |
| H | 0.04 | 0.04 | 1.32 | 0.008 | 0.0026 | 0.29 | 0.04 | — | — | 0.01 | 0.01 |
| I | 0.03 | 0.03 | 1.44 | 0.007 | 0.0034 | 0.30 | 0.06 | 0.01 | — | — | — |
| J | 0.05 | 0.05 | 1.36 | 0.006 | 0.0031 | 0.27 | 0.05 | — | 0.01 | 0.01 | — |

*Out of range defined in present invention

Then, a JIS No. 5 tensile test piece having the rolling direction as the tensile direction is collected from the steel sheet, a tensile test in accordance with JIS Z 2241(2011) was performed, and tensile strength (TS) and elongation at break (El) were measured. Further, as an index of the press-moldability, a hole expandability test was performed. In the hole expandability test, a burr of punched hole having a diameter of 10 mm was placed outward and the hole was forced to expand using a 60° conical punch, and a hole expansion rate (λ) was measured. The results thereof are shown in Table 5.

TABLE 5

| | Mechanical characteristics | | | |
|---|---|---|---|---|
| Steel | TS(MPa) | El(%) | λ (%) | Processability evaluation |
| A* | 498 | 35 | 130 | A |
| B* | 513 | 31 | 129 | A |
| C* | 638 | 24 | 97 | B |
| D* | 609 | 28 | 134 | A |
| E* | 608 | 27 | 127 | A |
| F* | 612 | 28 | 124 | A |
| G | 617 | 28 | 127 | A |
| H | 632 | 26 | 131 | A |
| I | 642 | 26 | 131 | A |
| J | 627 | 27 | 122 | A |

*Out of range defined in present invention

As it is clear from Table 5, Steel C, which had a composition component that was out of range defined in the present invention, had the total elongation (El) of 21% and the hole expansion rate of 97%, which were both insufficient, and the result of the press-moldability was low. On the other hand, although the pieces of Steel A, B, and D to F each had a composition component that was out of range defined in the present invention, each of their total elongation (El) was more than or equal to 25%, and hole expansion rate was more than or equal to 120%, so the press-moldability was sufficient. Further, the pieces of Steel G to J each having a composition component that was in a range defined in the present invention each had the total elongation (El) or more than or equal to 25% and the hole expansion rate of more than or equal to 120%, and thus each had an excellent press-moldability.

Next, the pieces of Steel A, B, and D to J, whose press-moldability were satisfactory, were subjected to the soft-nitriding treatment using the method shown below, and then examined their characteristics as soft-nitrided steel. First, test pieces for measuring hardness and test pieces for plane bending were collected from steel sheets using the above pieces of Steel. Then, those test pieces were subjected to gas soft-nitriding treatment involving being retained in the heating temperature and treatment time shown in Table 6 in atmosphere gas of $NH_3$:$N_2$:$CO_2$=50:45:5, and then being oil-cooled at oil temperature of 80° C. From the viewpoint of productivity, the treatment time was set to less than or equal to two hours.

ferrite crystal, since it is difficult to observe the nitrides precipitated on the (001) plane, the number of nitrides on the (100) plane and the number of nitrides on the (010) plane were counted, and the total number was multiplied by 1.5. The thickness of a TEM sample of the observed region was measured by using a log-ratio method of electron energy loss spectroscopy (EELS). The number density was determined by dividing the observed number of nitrides by a volume, the volume being determined by multiplying the area of the observed visual field by the thickness.

The Mn concentration in metal elements included in the nitrides was determined by measuring the Mn concentrations in ten nitrides using the TEM-EDS, and calculating the average value of the Mn concentrations. The results thereof are shown together in Table 6.

Further, using the test piece for measuring hardness, measurement of Vickers hardness was performed at a position of 50 μm from the surface of the steel sheet after the soft-nitriding treatment and at a sheet thickness central portion. The test condition was set to the test force of 0.3 kgf (2.942 N), and the average value of the measurement results of five points was determined. The hardness at the position of 50 μm from the surface of the steel sheet was set as surface hardness, and the hardness of the sheet thickness central portion was set as the hardness of the base material. Further, the distance from the surface of the steel sheet to the

TABLE 6

| | | Soft-nitriding treatment conditions | | Nitrides# | | | Mechanical characteristics after nitriding treatment | | | | |
|---|---|---|---|---|---|---|---|---|---|---|---|
| Test No. | Steel | Heating temperature (° C.) | Treatment time (h) | Maximum length‡ (nm) | Mn concentration (at %) | Number density ($m^{-3}$) | Surface layer hardness (Hv) | Hardening depth (mm) | Base material hardness (Hv) | Fatigue resistance | |
| 1 | A* | 570 | 2 | 6 | 81 | $2.3 \times 10^{24}$ | 638 | 0.42 | 128 | B | Comparative Example |
| 2 | B* | 570 | 2 | 3* | 56* | $0.86 \times 10^{24}$* | 448 | 0.36 | 187 | B | Comparative Example |
| 3 | D* | 570 | 2 | 5 | 97 | $0.73 \times 10^{24}$* | 437 | 0.43 | 199 | B | Comparative Example |
| 4 | E* | 570 | 2 | 8 | 55* | $3.7 \times 10^{24}$ | 712 | 0.30 | 207 | B | Comparative Example |
| 5 | F* | 570 | 2 | 8 | 80 | $2.5 \times 10^{24}$ | 638 | 0.39 | 127 | B | Comparative Example |
| 6 | G | 570 | 2 | 6 | 90 | $2.2 \times 10^{24}$ | 627 | 0.39 | 210 | A | Example |
| 7 | H | 570 | 2 | 6 | 84 | $2.3 \times 10^{24}$ | 616 | 0.38 | 217 | A | Example |
| 8 | I | 570 | 2 | 6 | 86 | $3.1 \times 10^{24}$ | 631 | 0.38 | 226 | A | Example |
| 9 | J | 570 | 2 | 7 | 87 | $2.1 \times 10^{24}$ | 622 | 0.40 | 219 | A | Example |
| 10 | G | 550 | 2 | 2* | 83 | $1.8 \times 10^{24}$ | 553 | 0.36 | 173 | B | Comparative Example |
| 11 | G | 610 | 2 | 12* | 83 | $0.67 \times 10^{23}$* | 476 | 0.38 | 180 | B | Comparative Example |

*Out of range defined in present invention
#Nitrides at depth position of 50 μm from outermost layer of steel
‡Average value of maximum lengths in each nitride A sample for TEM observation at depth position of 50 μm from the outermost layer was prepared from the test piece for measuring hardness through mechanical polishing or electrolytic polishing. Using the TEM, the shape of a nitride, the maximum length of a nitride, the number density of nitrides, and the Mn concentration in metal elements included in the nitrides were measured. The observation was carried out in the condition that a [001] direction of ferrite is parallel to an incident direction of an electron beam. The maximum length of a nitride was evaluated using an average value of nitrides included in an observed visual field.

Further, the number density of nitrides was evaluated as follows. Of the nitrides precipitated on the {001} plane in a depth at which the hardness is greater by 50 HV than the hardness of the base material was set as the hardening depth.

The fatigue resistance was evaluated in accordance with test of plane bending fatigue testing of metal plates described in JIS Z 2275 (1978) using a Schenck type plane bending fatigue testing machine. The frequency was set to 25 Hz, the stress ratio was set to R=−1, and the fatigue strength was evaluated at number of repetitions of $10^7$ cycles time strength.

Further, in the present examples, the hardening characteristics was evaluated as satisfactory when the surface hardness was more than or equal to 600 HV, the hardness of the base material is more than or equal to 180 HV, and the hardening depth is more than or equal to 0.35 mm. In addition, regarding the plane bending fatigue testing, when the fatigue strength was more than or equal to 600 MPa, the fatigue resistance was set as satisfactory (A), and when the fatigue strength was less than 600 MPa, the fatigue resistance was set as poor (B).

Figure 2:
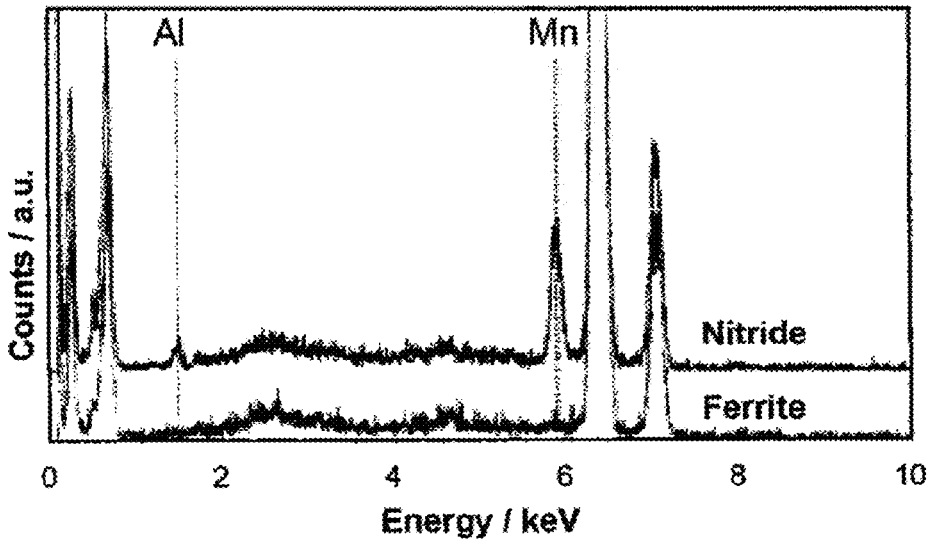
FIG. 2 is a diagram showing spectra of energy dispersive X-ray spectrometry (TEM-EDS) obtained from nitrides and a parent phase.

FIGS. 1 and 2 show results obtained by observing, using a TEM, nitrides at the depth position of 50 μm from the outermost surface of Test No. 6. FIG. 1 is an image captured by an annular dark-field STEM, which is one of observation techniques using the TEM, and it can be seen from the image that average 6-nm plate-like alloy nitrides coherent with a parent phase are highly densely distributed on the {001} plane. Further, FIG. 2 shows spectra of TEM-EDS obtained from nitrides and ferrite, which is a parent phase. From FIG. 2, it can be understood that the nitrides observed in FIG. 1 are nitrides that contain Mn and Al as main component.

As it is clear from Table 6, Test Nos. 1 to 5, which are Comparative Examples whose chemical compositions deviate from the chemical composition defined in the present invention, each had a result in which the fatigue resistance was poor. Test No. 1 had low C content, so the amount of precipitation of carbides in the base material was insufficient. Therefore, the hardness of the base material was low, and the fatigue resistance was poor. Test No. 2 had low Mn content, so the nitrogen which was dissolved as a solid solution and entered from the surface was not consumed as nitrides in the vicinity of the surface. Therefore, although the hardening depth was sufficient, the sizes of the nitrides that had been formed were small, and the number density of the nitrides also decreased. Accordingly, the results were obtained that the precipitation strengthening was not sufficient, the surface hardness was low, and the fatigue resistance was poor.

Test No. 3 had low Al content, so the acceleration of nitride formation was not sufficient. Therefore, the number density decreased, and the precipitation strengthening of the surface layer was not sufficient. Accordingly, the hardness of the surface layer decreased, and the fatigue resistance was poor. Test No. 4 had high Al content, so the Mn concentration in the nitrides relatively decreased, and nitrides each having a crystal composition of M1N1 were formed. Accordingly, the nitrogen which was dissolved as a solid solution and entered from the surface was consumed in the vicinity of the surface of Sample to thereby decrease the hardening depth, and as a result, the fatigue resistance was poor. Test No. 5 had low Ti content, so the precipitation of carbides in the base material was insufficient. Therefore, the hardness of the base material was low, and the fatigue resistance was poor.

Further, Test Nos. 10 and 11 are Comparative Examples which satisfied the chemical compositions defined in the present invention, but in which the precipitation form of nitrides at the depth position of 50 μm from the outermost surface deviated from the present invention since the conditions of the soft-nitriding treatment were inappropriate. In Test No. 10, the sizes of the precipitated nitrides were small, and hence the magnitude of the coherency strain accompanied by the nitride formation was not sufficient, and the precipitation strengthening was small. As a result, the hardness of the surface layer decreased, and the fatigue resistance was poor. Further, in Test No. 11, since the sizes of the precipitated nitrides were large, incoherency had been progressed, and the number density was small, the precipitation strengthening was small. As a result, the hardness of the surface layer decreased, and the fatigue resistance was poor.

On the other hand, it was found that Test Nos. 6 to 9, which are Examples that satisfy all requirements of the present invention, each had satisfactory fatigue resistance: sufficient hardness of the surface layer was obtained, that is, the hardness at the depth position of 50 μm from the outermost surface was more than or equal to 600 HV; the hardening depth was large, which was more than or equal to 0.35 mm; and the hardness of the base material exceeded 200 HV.

INDUSTRIAL APPLICABILITY

According to the present invention, there can be provided the soft-nitrided steel having excellent fatigue resistance without deteriorating productivity and economic efficiency, which is excellent in press-moldability such as stretch flangeability and hole expandability before the soft-nitriding treatment, and in which a hardened layer having a sufficient thickness from the surface is formed after the soft-nitriding treatment. The steel sheet for soft-nitriding treatment and the soft-nitrided steel according to the present invention having such characteristics are suitable for being used as a part for a general structure such as a part for an automobile.

The invention claimed is:

1. A steel sheet for soft-nitriding treatment which
has a chemical composition consisting of, in mass %,
C: more than or equal to 0.02% and less than 0.07%,
Si: less than or equal to 0.10%,
Mn: 1.1 to 1.8%,
P: less than or equal to 0.05%,
S: less than or equal to 0.01%,
Al: 0.10 to 0.45%,
N: less than or equal to 0.01%,
Ti: 0.01 to 0.10%,
Nb: 0 to 0.1%,
Mo: 0 to 0.1%,
V: 0 to 0.1%,
Cr: 0 to 0.2%, and
the balance: Fe and impurities,
satisfies the following formula (i), and
has a total content of Ti, Nb, Mo, V, and Cr present as precipitates in the steel sheet of less than 0.03% in mass %,
wherein the steel sheet for soft-nitriding treatment has a metal structure in which a ferrite area ratio is more than or equal to 80%, and a ferrite dislocation density at a position of 50 μm from a surface of the steel sheet is $1\times10^{14}$ to $1\times10^{16}$ $m^{-2}$, $$Mn+Al\geq1.5 \quad (i)$$

where each chemical symbol included in the formula represents a content (mass %) of each element contained in the steel sheet.

2. The steel sheet for soft-nitriding treatment according to claim 1,
wherein the chemical composition comprises, in mass %, one or more selected from
Nb: 0.005 to 0.1%,
Mo: 0.005 to 0.1%,
V: 0.005 to 0.1%, and
Cr: 0.005 to 0.2%.

3. A method of manufacturing a steel sheet for soft-nitriding treatment, the method comprising:
starting rolling of a steel raw material having a chemical composition recited in claim 1 after the steel raw material is heated to higher than or equal to 1150° C., and ending the rolling at finishing temperature of higher than or equal to 900° C.;

performing coiling, after cooling, in a temperature region of 470 to 530° C. to cause ferrite area ratio to be more than or equal to 80%;

thereafter subjecting the steel raw material to pickling; and subjecting the steel raw material to skin pass rolling after the pickling in conditions in which a rolling reduction ratio is 0.5 to 5.0%, and F/T (mm) is more than or equal to 8000, said F/T (mm) being a ratio of a line load F (kg/mm) determined by dividing a rolling mill load by a width of the steel sheet to a load T (kg/mm$^2$) per unit area applied in a longitudinal direction of the steel sheet to thereby obtain the steel sheet of claim 1.

4. A soft-nitrided steel having a chemical composition consisting of, in mass %, C: more than or equal to 0.02% and less than 0.07%, Si: less than or equal to 0.10%, Mn: 1.1 to 1.8%, P: less than or equal to 0.05%, S: less than or equal to 0.01%, Al: 0.10 to 0.45%, Ti: 0.01 to 0.10%, Nb: 0 to 0.1%, Mo: 0 to 0.1%, V: 0 to 0.1%, Cr: 0 to 0.2%, and the balance: Fe and impurities, wherein, at a depth position of 50 μm from an outermost surface, nitrides are precipitated on a {001} plane in a ferrite crystal, an average value of maximum lengths of the respective nitrides is 5 to 10 nm, and a number density of nitrides is more than or equal to $1\times10^{24}$ m$^{-3}$.

5. The soft-nitrided steel according to claim 4, wherein the chemical composition contains, in mass %, one or more selected from Nb: 0.01 to 0.1%, Mo: 0.01 to 0.1%, V: 0.01 to 0.1%, and Cr: 0.01 to 0.2%.

6. The soft-nitrided steel according to claim 4, wherein a Mn concentration in metal elements included in the nitrides is more than or equal to 80 at %.

* * * * *